US007031635B2

(12) United States Patent
Huang et al.

(10) Patent No.: US 7,031,635 B2
(45) Date of Patent: Apr. 18, 2006

(54) TONER CARTRIDGE

(75) Inventors: Ya-Li Huang, Taichung (TW); Ching-Yu Huang, Taichung (TW); Hui-Yen Wang, Taichung (TW)

(73) Assignee: General Plastic Industrial Co., Ltd., Taichung (TW)

( * ) Notice: Subject to any disclaimer, the term of this patent is extended or adjusted under 35 U.S.C. 154(b) by 40 days.

(21) Appl. No.: 10/839,182

(22) Filed: May 6, 2004

(65) Prior Publication Data

US 2005/0249518 A1 Nov. 10, 2005

(51) Int. Cl.
*G03G 15/08* (2006.01)

(52) U.S. Cl. ..... 399/106; 399/262

(58) Field of Classification Search ..... 399/106, 399/105, 120, 262
See application file for complete search history.

(56) References Cited

U.S. PATENT DOCUMENTS 6,665,508 B1 * 12/2003 Sudo et al. ..... 399/258
6,671,482 B1 * 12/2003 DiIanni et al. ..... 399/262

* cited by examiner

*Primary Examiner*—Arthur T. Grimley
*Assistant Examiner*—Laura K. Roth
(74) *Attorney, Agent, or Firm*—Browdy and Neimark, PLLC

(57) ABSTRACT

The present invention relates to a toner cartridge, which contains the toner directly in a housing. The housing has an opening. A plug is disposed in the housing where the opening is. The plug has a small diameter portion that has a diameter smaller than the opening. A piston is disposed in the housing to be biased by an elastic member to the plug for sealing the opening. Such toner cartridge has a simple structure to reduce the cost of fabrication and use and has a function of preventing leaking toner.

3 Claims, 6 Drawing Sheets

TONER CARTRIDGE

BACKGROUND OF THE INVENTION

1. Field of the Invention

The present invention relates generally to an electrical image forming device, and more particularly to a toner cartridge with a simple structure and with the function of preventing toner leakage.

2. Description of the Related Art

FIG. 5 shows a conventional toner cartridge 1 having a housing 2, a soft bag 3 received in the housing 2 to contain toner and an output device 4 disposed at an outlet of the soft bag 3. The output device 4 is extended out of the housing 2 through an opening 5. When the toner runs out, both the soft bag 3 and the output device 4 are drawn out of the housing 2 for replacement. The old soft bag 3 and the output device 4 are dropped as a waste that does not meet the requirement of recycle and economic benefit.

In fact, the conventional toner cartridge 1 designating its soft bag 3 and the output device 4 having to be dropped has an essential reason for its structure. As shown in FIG. 6, the output device 4 is provided with a connector 6 to be received in the opening 5 of the housing 2 for coupling the soft bag 3 with the housing 2. The connector 6 has a tube 7 therein and the tube 7 is extended into the soft bag 3. A piston 8 is disposed in the tube 7. The piston 8 is provided with a hook 81 on the top to hook on an end of the tube 7. The piston 8 is provided with a head 82 at the bottom. A spring 83 is provided to bias the piston 8 downward. The head 82 of the piston 8 is squeezed into a hole 91 of a sponge 9 for seal of the soft bag 3. While outputting the toner in the soft bag 3, a driving member 92 is inserted into the hole 91 of the sponge 9 and moves the piston 8 upwards, which overcomes the force of the spring 83, to force the head 82 of the piston 8 to leave the hole 91 of the sponge 9. The toner is dropped out via a hole 93 of the driving member 92. There is always a friction between the sponge 9 and the head 82 of the piston 8, so that there is a gap between the sponge 9 and the head 82 after a long time of use and it makes a leakage of toner. For the above reason, the soft bag 3 and the output device 4 have to be replaced. It is a drawback of the structure.

SUMMARY OF THE INVENTION

The primary objective of the present invention is to provide a toner cartridge, which has no problem of leakage after a long period of use.

The secondary objective of the present invention is to provide a toner cartridge, which has a novelty and simple structure to reduce the cost.

According to the objectives of the present invention, a toner cartridge comprises a housing, a plug, a piston and an elastic member. The housing has a chamber for containing toner, an opening and an inner tube disposed in the chamber and communicated with the opening. The inner tube is provided with a supporting portion at a distal end thereof and a hollow portion. The plug is disposed in the housing, which has a through hole at a center thereof communicated with the opening of the housing. The through hole has a small diameter portion which has a diameter smaller than a diameter of the opening. The piston is slidably disposed in the inner tube of the housing. The elastic member is disposed in the inner tube of the housing with opposite ends thereof against the supporting portion of the housing and the piston to bias the piston to the plug for sealing the opening.

DETAILED DESCRIPTION OF THE INVENTION

Figure 1:
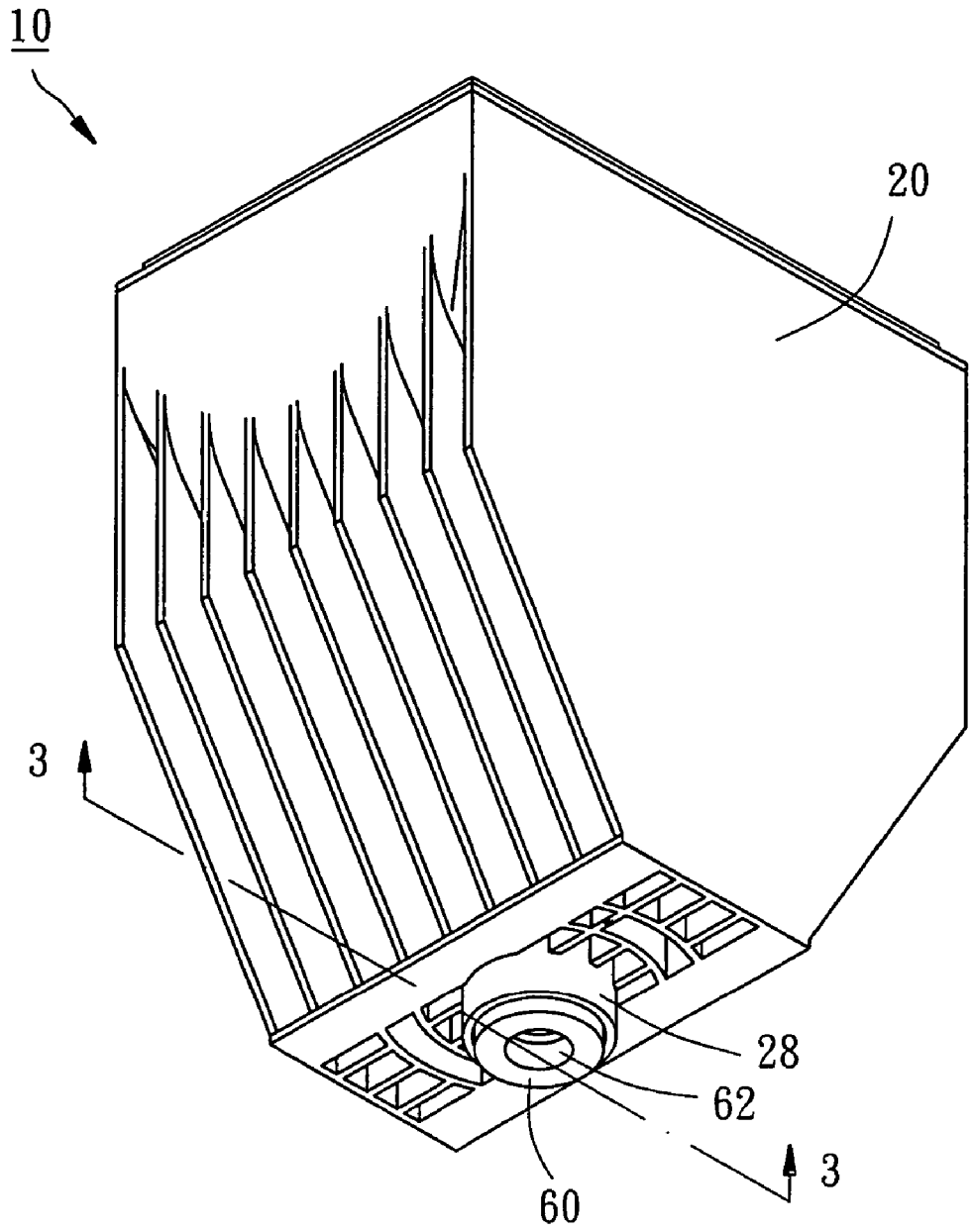
FIG. 1 is a perspective view of a preferred embodiment of the present invention.
Figure 2:
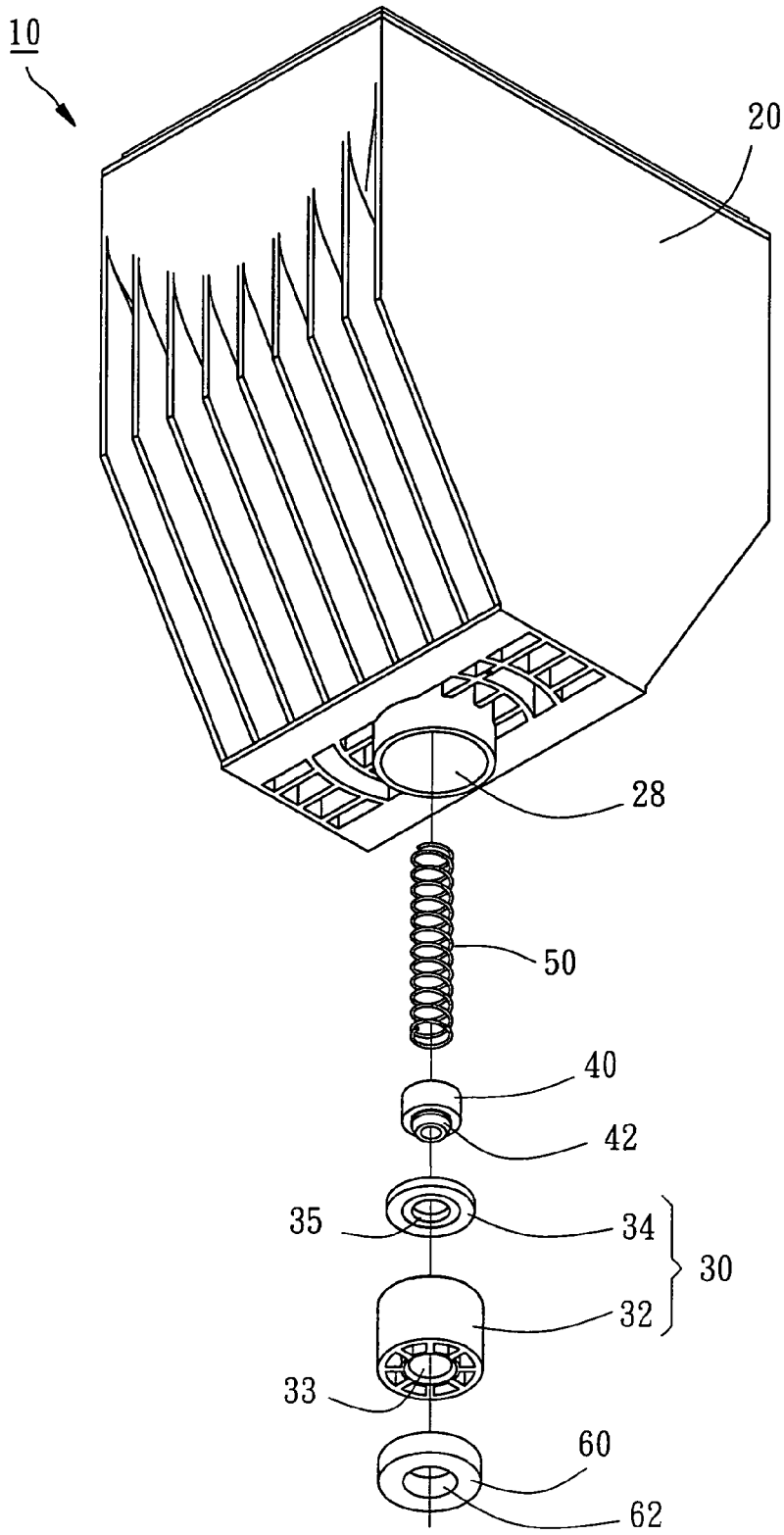
FIG. 2 is an exploded view of the preferred embodiment of the present invention.
Figure 3:
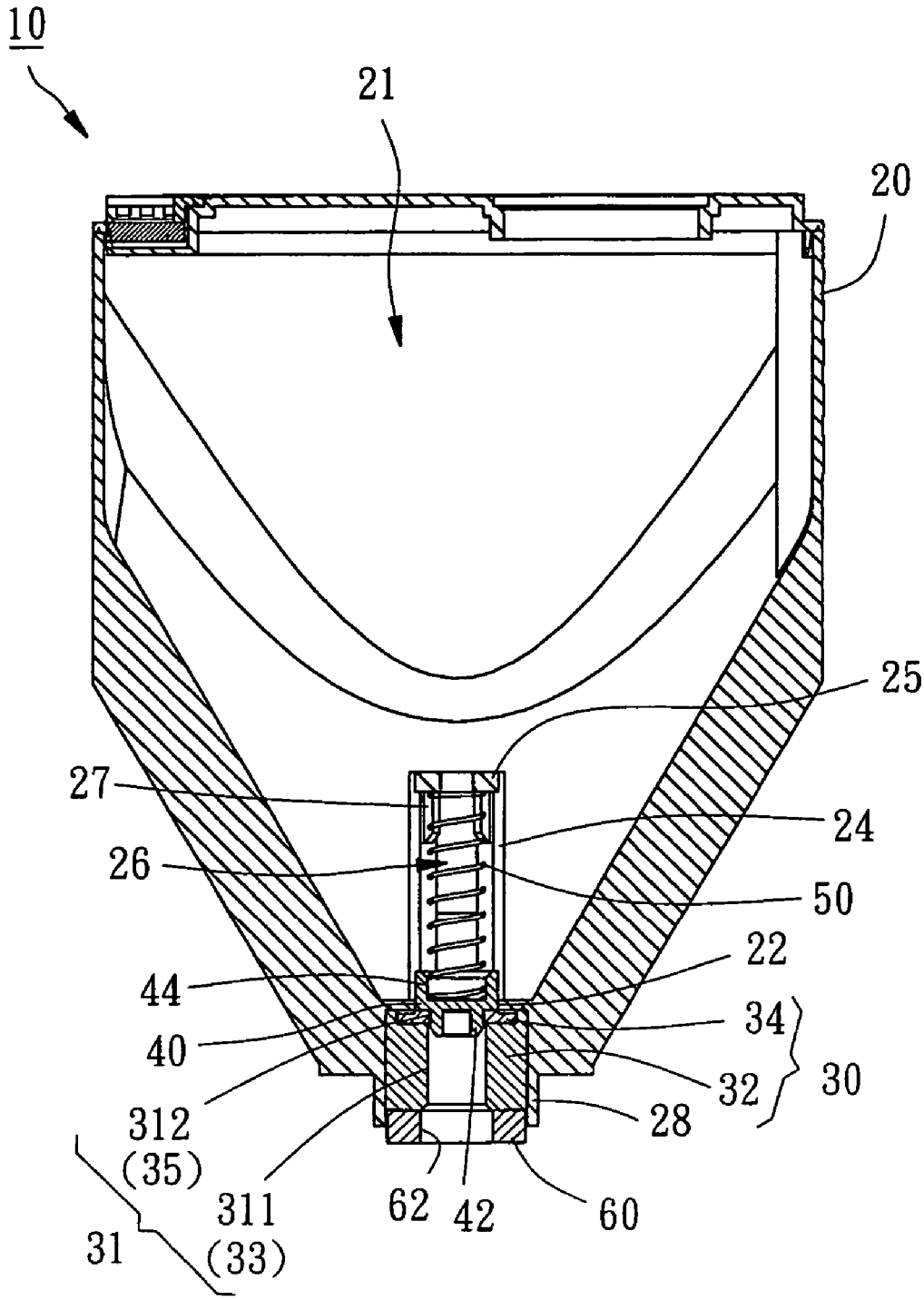
FIG. 3 is a sectional view along the 3—3 line of FIG. 1.

As shown in FIGS. from FIG. 1 to FIG. 3, a toner cartridge 10 of the preferred embodiment of the present invention comprises a housing 20, a plug 30, a piston 40, an elastic member 50 and a buffer member 60.

The housing 20 is a container having a broad top and a narrow bottom and is made of a hard material, such as plastics or cardboard. The housing 20 has a chamber 21 for containing toner. The housing 20 has an opening 22 at the bottom and an inner tube 24 extending from an interior wall thereof and communicating with the opening 22. On a distal end of the inner tube 24, a supporting portion 25 is provided engaged to an elastic member 50. The inner tube 24 has four hollow portions 26 oriented in a vertical direction. The toner runs into the inner tube 24 through the hollow portions 26. The inner tube 24 is provided with four ribs 27 on an interior wall thereof to position the elastic member 50. The housing 20 has a straight tube 28 extending from an exterior wall thereof and communicating with the opening 22 for holding the plug 30.

The plug 30 has a through hole 31 at a center thereof communicating with the opening 22 of the housing 20. In the present preferred embodiment, the plug 30 has a fixing member 32 fixed in the straight tube 28 of the housing 20 and a washer 34 disposed between the fixing member 32 and the housing 20. The washer 34 is made of an elastic material, such as rubber. The fixing member 32 has a hole 33 defining a large diameter portion 311 of the through hole 31 and the washer 34 has a hole 35 defining a small diameter portion 312 of the through hole 31. A diameter of the small diameter portion 312 is smaller than a diameter of the opening 22. In practice, the plug can also be molded to be a single unit.

The piston 40 is slidably disposed in the inner tube 24 of the housing 20 to seal the opening 22, but there is still a gap between the piston 40 and the opening 22. The piston 40 has a protruding portion 42 to be fitted exactly in the hole 35 of the washer 34 for sealing the chamber 21 and the opening 22. The piston 40 has a resting portion 44 at a top thereof to support a bottom end of the elastic member 50. In practice, the shape of the piston is not restricted in the embodiment. It could be any shape, like a ball for example.

The elastic member 50 is disposed in the inner tube 24 of the housing 20 with opposite ends thereof against the supporting portion 25 of the inner tube 24 and the piston 40. The elastic member 50 biases the piston 40 downward to the washer 34 of the plug 30 for sealing the opening 22.

The buffer member 60 is connected to a bottom of the fixing member 32 of the plug 30. The buffer member 60 has a through hole 62 communicating with the through hole 31 of the plug 30. The buffer member 60 is made of sponge, rubber or other elastic materials. The buffer member 60 is not the necessary component of the toner cartridge 10 of the present invention.

Figure 4:
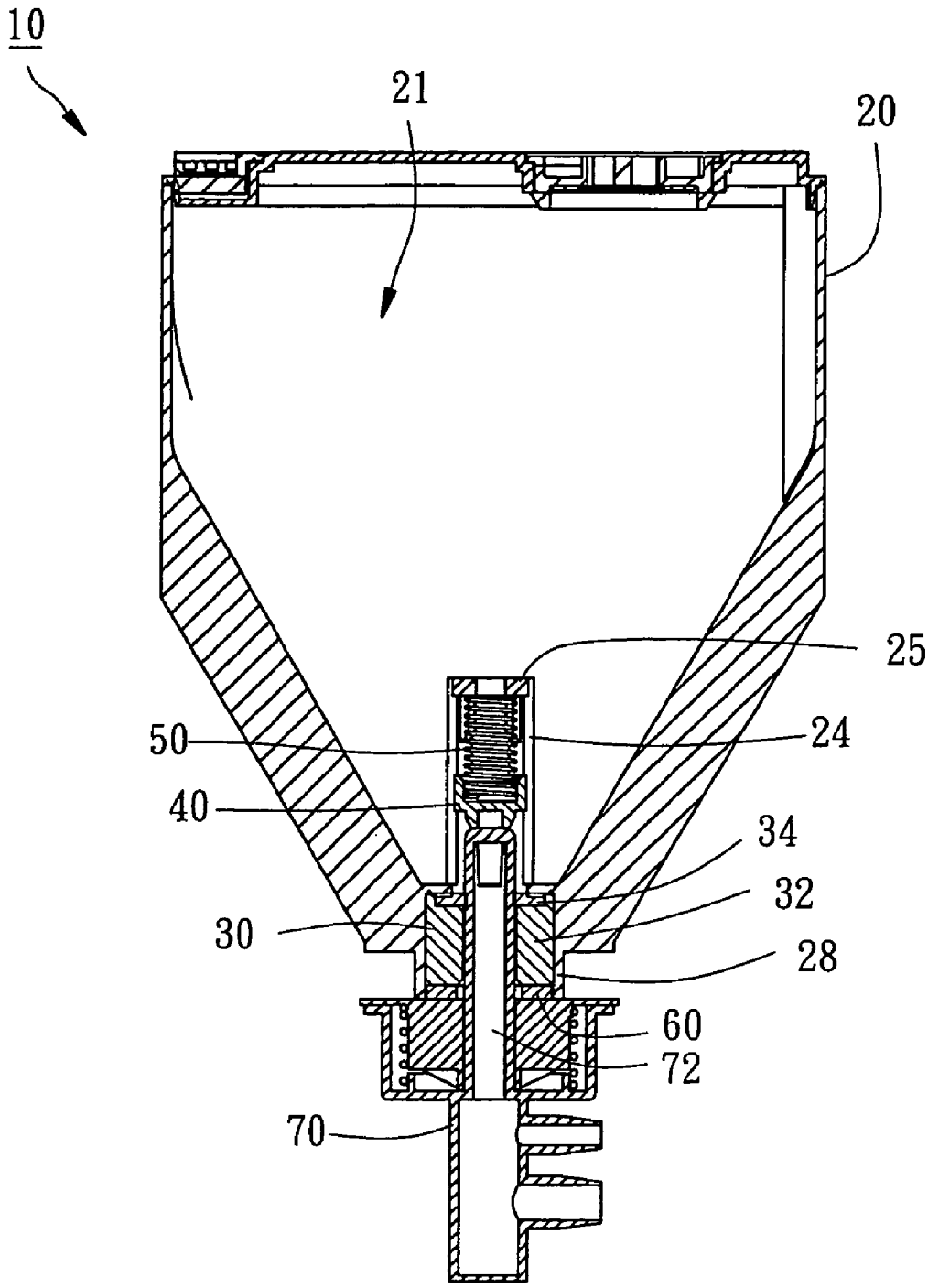
FIG. 4 is a sectional view of the preferred embodiment of the present invention, showing its action.
Figure 5:
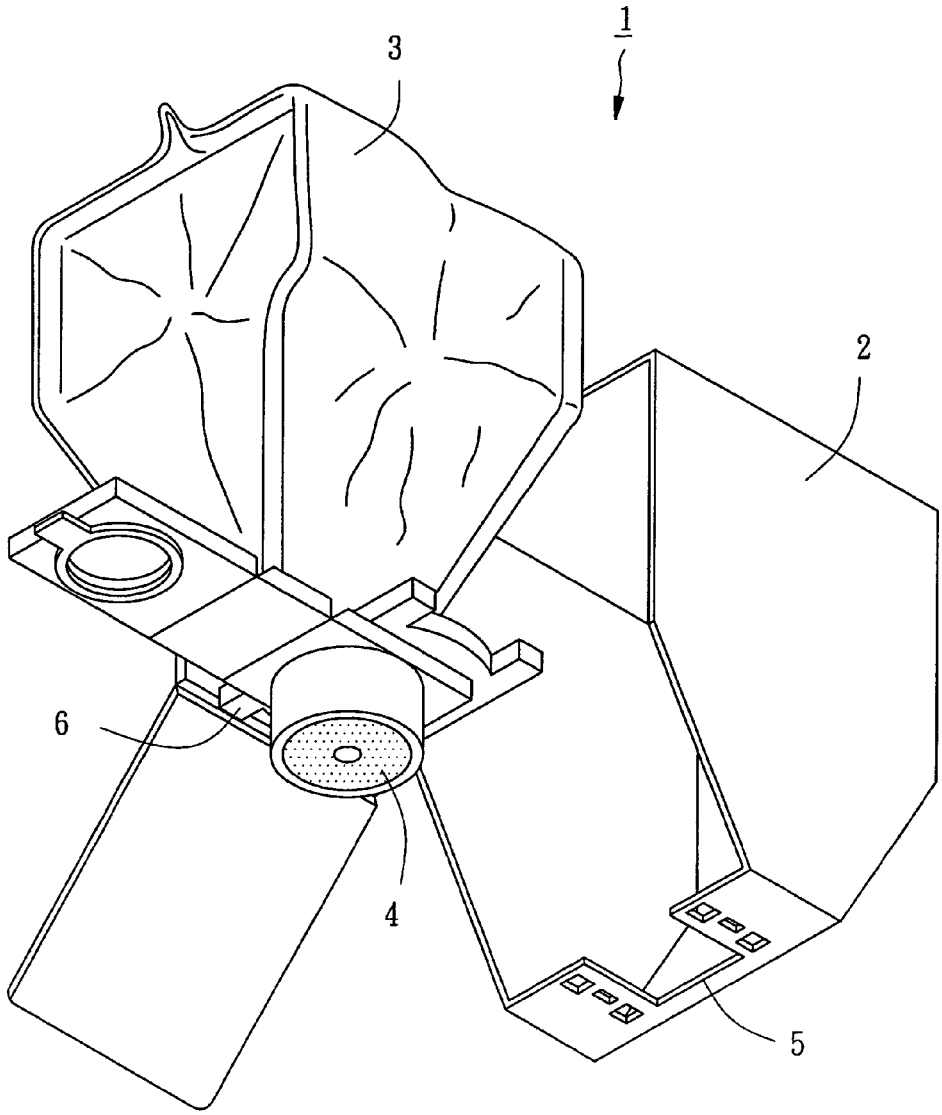
FIG. 5 PRIOR ART
FIG. 5 is a perspective view of the conventional toner cartridge.
Figure 6:
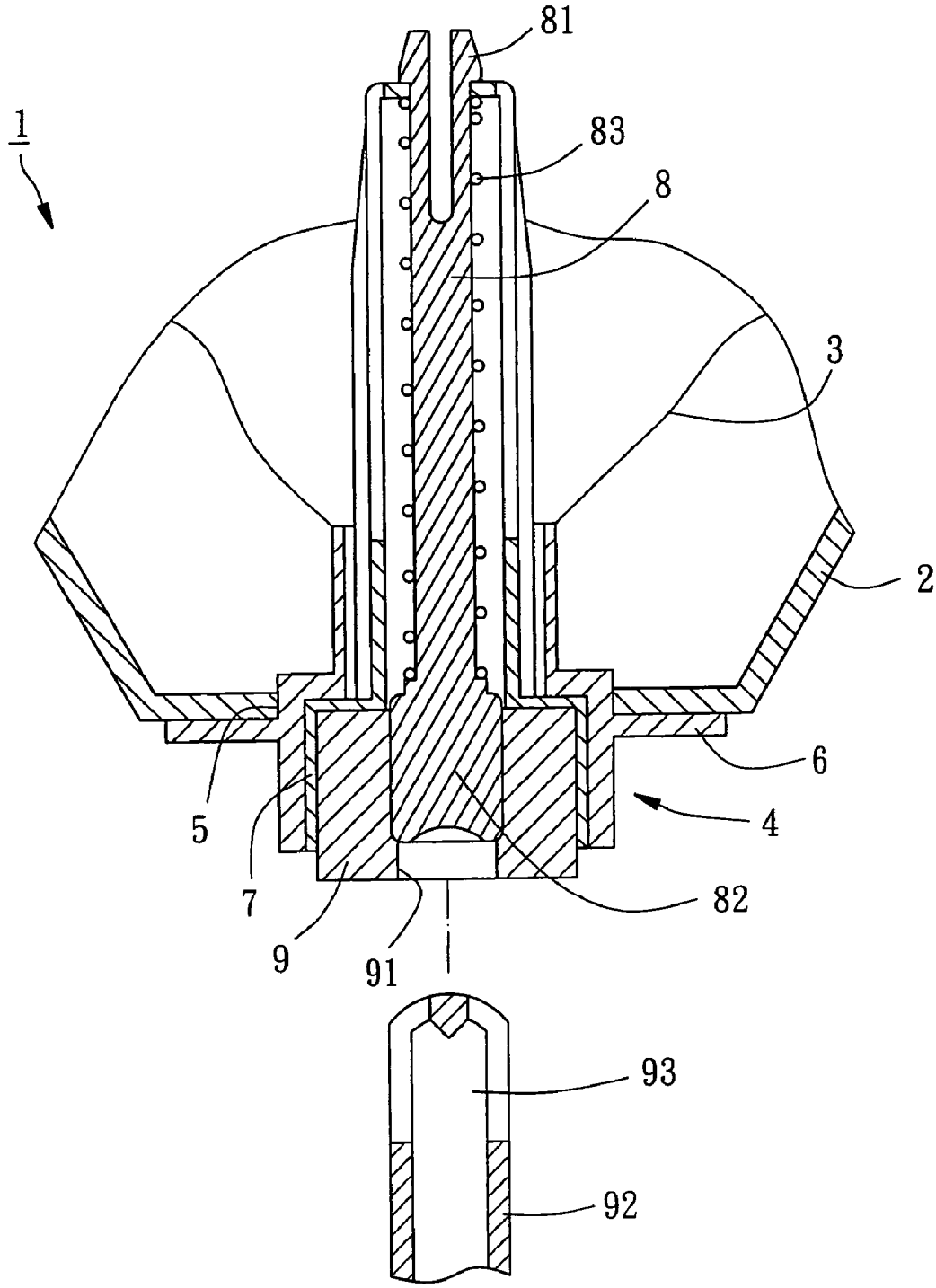
FIG. 6 PRIOR ART
FIG. 6 is a sectional view in a part of the conventional toner cartridge.

While discharging the toner, as shown in FIG. 4, a driving member 70 runs through the holes 62, 33 and 35 of the buffer member 60, the fixing member 32 and the washer 34 and moves the piston 40 upwards, to overcome the force of the elastic member 50. In this position the chamber 21 is not sealed and the toner is discharged via an inner hole 72 of the driving member 70.

When the piston 40 is biased by the elastic member 50 to the washer 34, the protruding portion 42 of the piston 40 is squeezed into the hole 35 of the washer 34. When the piston 40 is squeezed in the opening 22 of the housing 20, the chamber 21 is exactly sealed since there is no gap between the piston 40 and the washer 34, which would result in toner leakage, even after a long period of use. Accordingly, the present invention overcomes the drawback of the conventional one.

In addition, because the toner cartridge 10 has no leakage problem, it can be used repeatedly. The toner is added into the chamber 21 of the housing 20 directly. When the toner runs out, the user only needs to refill the toner and the toner cartridge 10 for continued use as no part of the toner cartridge 10 of the invention needs replacement. This permits long use of the invention that will reduce the operating cost. In addition, the present invention provides a simple structure that will reduce the cost of fabrication.

What is claimed is:

1. A toner cartridge, comprising a housing having a chamber for containing toner, an opening and an inner tube fixed to the housing and extending into the chamber in communication with the opening, wherein the inner tube is provided with a supporting portion at a distal end thereof and a hollow portion open to the chamber;

a straight tube extending away from the housing in communication with the opening in the housing;

a plug engaged in the straight tube having a through hole at a center thereof communicating with the opening in the housing, the plug comprising a fixing member fixed in the straight tube and an elastic washer disposed in the straight tube between the fixing member and the housing;

wherein the fixing member and the elastic washer each have a hole which together form the through hole of the plug;

wherein the diameter of the hole of the elastic member is smaller than that of the opening in the housing and also that of the hole in the fixing member;

a stepped piston slidably engaged in the inner tube, wherein the piston has a resting portion having an outer diameter larger than that of the hole in the elastic washer and smaller than that of the opening in the housing and a protruding portion which can be squeezably engaged against the circumference of the hole of the elastic washer; and an elastic member disposed in the inner tube with opposite ends thereof respectively engaged to the supporting portion of the inner tube and the resting portion of the piston to bias the resting portion against the top surface of the washer and the protruding portion into engagement in the hole of the washer.

2. The toner cartridge as defined as claim 1, further comprising a buffer member connected to the plug, wherein the buffer member has a through hole communicating with the through hole of the plug.

3. The toner cartridge as defined in claim 1, wherein the inner tube is provided with a plurality of ribs to position the elastic member.

* * * * *